US008102328B2

(12) United States Patent
Fink et al.

(10) Patent No.: US 8,102,328 B2
(45) Date of Patent: Jan. 24, 2012

(54) METHOD AND DEVICE FOR THE TRANSMISSION OF WAVES

(75) Inventors: Mathias Fink, Meudon (FR); Geoffroy Lerosey, Paris (FR); Julien De La Gorgue De Rosny, Paris (FR); Arnaud Tourin, Sevres (FR)

(73) Assignee: Centre National de la Recherche Scientifique (CNRS), Paris (FR)

( * ) Notice: Subject to any disclaimer, the term of this patent is extended or adjusted under 35 U.S.C. 154(b) by 364 days.

(21) Appl. No.: 12/373,192

(22) PCT Filed: Jul. 11, 2007

(86) PCT No.: PCT/FR2007/051644
§ 371 (c)(1),
(2), (4) Date: Jan. 9, 2009

(87) PCT Pub. No.: WO2008/007024
PCT Pub. Date: Jan. 17, 2008

(65) Prior Publication Data

US 2009/0309805 A1 Dec. 17, 2009

(30) Foreign Application Priority Data

Jul. 11, 2006 (FR) ..... 06 06315

(51) Int. Cl.
*H01Q 19/10* (2006.01)

(52) U.S. Cl. ..... 343/837; 343/833; 343/834; 343/893

(58) Field of Classification Search ..... 343/833, 343/834, 893, 836, 837
See application file for complete search history.

(56) References Cited

U.S. PATENT DOCUMENTS

| | | | | |
|---|---|---|---|---|
| 5,767,807 | A * | 6/1998 | Pritchett | 342/374 |
| 5,926,768 | A | 7/1999 | Lewiner et al. | |
| 6,515,635 | B2 * | 2/2003 | Chiang et al. | 343/834 |
| 6,600,456 | B2 * | 7/2003 | Gothard et al. | 343/834 |
| 6,864,852 | B2 * | 3/2005 | Chiang et al. | 343/817 |
| 7,176,844 | B2 * | 2/2007 | Chiang et al. | 343/815 |
| 2004/0054282 | A1 | 3/2004 | Aubry et al. | |
| 2006/0187754 | A1 | 8/2006 | Fink et al. | |
| 2007/0080891 | A1 | 4/2007 | De Lustrac et al. | |
| 2007/0211788 | A1 | 9/2007 | Fink et al. | |

FOREIGN PATENT DOCUMENTS

| | | |
|---|---|---|
| EP | 0 803 991 | 10/1997 |
| EP | 0 812 026 | 12/1997 |
| EP | 1 113 523 | 7/2001 |
| FR | 2 815 717 | 4/2002 |
| FR | 2 863 109 | 6/2005 |

OTHER PUBLICATIONS

French Search Report of priority patent application FR 06 06315; Report dated Jan. 19, 2007. International Search Report from counterpart application No. PCT/FR2007/051644; Report dated Oct. 29, 2007.

Lerosey, et al.; Time Reversal of Electromagnetic Waves; Physical Review Letters; The American Physical Society; Week ending May 14, 2004; pp. vol. 92, No. 19.

* cited by examiner

*Primary Examiner* — Hoang V Nguyen
(74) *Attorney, Agent, or Firm* — Miller, Matthias & Hull LLP

(57) ABSTRACT

Method for focusing an electromagnetic or acoustic wave on a point near which one or more diffusers are placed, comprising a learning step in which the pulsed responses $h_{ij}(t)$ between the focus point and each antenna of the network are determined. Waves corresponding to signals $S_{ji}(t)=S_i(t)\otimes h_{ij}(-t)$, where $S_i(t)$ is a function of time and $h_{ij}(-t)$ is a temporal inversion of the pulsed response $h_{ij}(t)$, can then be transmitted form said antennas of the network.

22 Claims, 2 Drawing Sheets

METHOD AND DEVICE FOR THE TRANSMISSION OF WAVES

CROSS-REFERENCE TO RELATED APPLICATIONS

This application is a U.S. national stage filing of International Patent Application No. PCT/FR2007/051644 filed on Jul. 11, 2007, which claims priority under the Paris Convention to French Patent Application No. 06 06315, filed on Jul. 11, 2006.

FIELD OF THE DISCLOSURE

The present invention relates to methods and devices for the transmission of electromagnetic or acoustic waves.

BACKGROUND OF THE DISCLOSURE

More particularly, the invention relates to a method for the transmission of waves chosen from electromagnetic waves and acoustic waves, in order to focus a wave of wavelength $\lambda$ (the wavelength corresponding to the central frequency of the wave) at at least one focal point of index i, the wave being emitted by antennas of index j belonging to a first array.

Document EP-A-0 803 991 describes an example of such a method, which allows good focusing onto the point i.

The object of the present invention is in particular to improve methods of this type, so as to enable the precision of the focusing onto the point i to be improved.

SUMMARY OF THE DISCLOSURE

For this purpose, according to the invention, a method of the kind in question is characterized in that at least one diffuser (which may itself be an antenna) for the wave is used close to the focal point i, said diffuser being located at a distance smaller than a predetermined distance from said focal point, said predetermined distance being at most equal to $\lambda/10$.

Thanks to these arrangements, high focusing precision may be obtained, for example by implementing a method in which:

an evanescent wave is produced at the point i, so that the diffuser or diffusers convert this evanescent wave into a propagating wave, which can propagate right to the antennas of the first array;

the impulse responses $h_{ij}(t)$ between the point i and the antennas j are then determined from the signals picked up by the antennas j; and then the antennas j of the first array are made to emit a wave corresponding to a signal $S_{ji}(t)=S_i(t)\otimes h_{ij}(-t)$, where $S_i(t)$ is a function of the time and $h_{ij}(-t)$ is the temporal inversion of the impulse response $h_{ij}(t)$; the diffuser or diffusers then recreate evanescent waves from the received propagating wave, and these evanescent waves may be focused onto the point i with great precision, the focal spot produced being of very small size compared with the wavelength of the signal. Thus, the width of the focal spot may for example be around $\lambda/30$.

In embodiments of the method according to the invention, one or more of the following arrangements may optionally be furthermore employed:

the method comprises at least:

(a) a learning step in which an impulse response $h_{ij}(t)$ between the focal point i and each antenna j of the first array is determined from signals exchanged between the antennas j of the first array and at least one antenna located at the focal point i and belonging to a second array (the second array may be optionally limited to a single antenna); and (b) a focusing step during which waves corresponding to signals $S_{ji}(t)=S_i(t)\otimes h_{ij}(-t)$, are emitted from said antennas j of the first array, where $S_i(t)$ is a function of the time and $h_{ij}(-t)$ is a temporal inversion of the impulse response $h_{ij}(t)$ between the focal point i and the antenna j, at least the diffusers remaining present around the focal point i during the focusing step (the signal received at point i is then close to $S_i(t)$). It should be noted that, during the focusing step, it may in certain cases be required to omit the antenna located at the point i, for example in applications with the aim of treating a zone around the point i;

during the learning step:

a wave corresponding to a predetermined signal is emitted by the antenna of the second array, said antenna being located at said focal point i;

signals generated by said wave are picked up on the antennas of index j of the first array; and an impulse response $h_{ij}(t)$ between the focal point i and each antenna j of the first array is determined from the signals picked up;

the antenna of the second array is present at the focal point i during the focusing step and a communication is established between said antenna and the antennas of the first array;

the learning step is carried out for several focal points of index i where antennas of the second array are placed respectively, each having at least one diffuser located at a distance smaller than said predetermined distance relative to the corresponding focal point i, and, during the focusing step, waves corresponding to at least signals $S_{ji}(t)=S_i(t)\otimes h_{ij}(-t)$, are emitted at each antenna j of the first array, where i is the index of one of the desired focal points;

during the focusing step, waves corresponding to a superposition of signals $S_{ji}(t)=S_i(t)\otimes h_{ij}(-t)$, for several values of i, are emitted by each antenna j of the first array;

the antennas of the second array are present at the focal points i during the focusing step and, during the focusing step, a selective communication is established between the antennas j of the first array and at least certain of said antennas of the second array;

several diffusers, preferably at least 10 diffusers, located at a distance smaller than said predetermined distance from the focal point i, are used;

the predetermined distance is at most equal to $\lambda/50$;

the wave is electromagnetic;

the wave has a frequency f (central frequency) of between 0.7 and 50 GHz;

the antenna of the second array used at the desired focal point has an impedance having an imaginary part greater than the real part so as to essentially generate a reactive field;

the imaginary part of the impedance of the antenna of the second array is greater than 50 times the real part; and metallic diffusers are used.

Moreover, the subject of the invention is also a device for receiving an electromagnetic wave of wavelength $\lambda$ at least one point of index i, this device comprising at least one metallic diffuser for the electromagnetic wave, these being located at a distance smaller than a predetermined distance from the point i, said predetermined distance being at most equal to $\lambda/10$, where $\lambda$ is the wavelength of the electromagnetic wave.

In embodiments of the device according to the invention, the device comprises several metallic diffusers, preferably at least 10 metallic diffusers, at a distance smaller than the predetermined distance from the point i;

the predetermined distance is at most equal to $\lambda/50$;

the device comprises, at point i, an antenna belonging to a second array (the second array may be optionally limited to a single antenna);

the antenna of the second array has an impedance having an imaginary part greater than the real part, so as to essentially generate an evanescent field;

the imaginary part of the impedance is greater than 50 times the real part;

the device comprises several antennas of index j belonging to a first array, and an electronic central processing unit controlling said antennas j of the first array in order for electromagnetic waves corresponding to signals $S_{ji}(t)=S_i(t)\otimes h_{ij}(-t)$, to be emitted by said antennas j of the first array, where $S_i(t)$ is a function of the time and $h_{ij}(-t)$ is a temporal inversion of the impulse response $h_{ij}(t)$ between the point i and each antenna j of the first array;

the second array comprises several antennas that are located at several points of index i and are surrounded by metallic diffusers located respectively at a distance smaller than said predetermined distance relative to the corresponding point i and the electronic central processing unit is designed to make each antenna j of the first array emit electromagnetic waves corresponding to at least signals $S_{ji}(t)=S_i(t)\otimes h_{ij}(-t)$; and the electronic central processing unit is designed to make each antenna j of the first array emit electromagnetic waves corresponding to a superposition of signals $S_{ji}(t)=S_i(t)\otimes h_{ij}(-t)$, for several values of i.

Other features and advantages of the invention will become apparent during the following description of one of its embodiments, given by way of nonlimiting example and with reference to the appended drawings.

DETAILED DESCRIPTION OF THE DISCLOSURE

In the various figures, the same references denote identical or similar elements.

Figure 1:
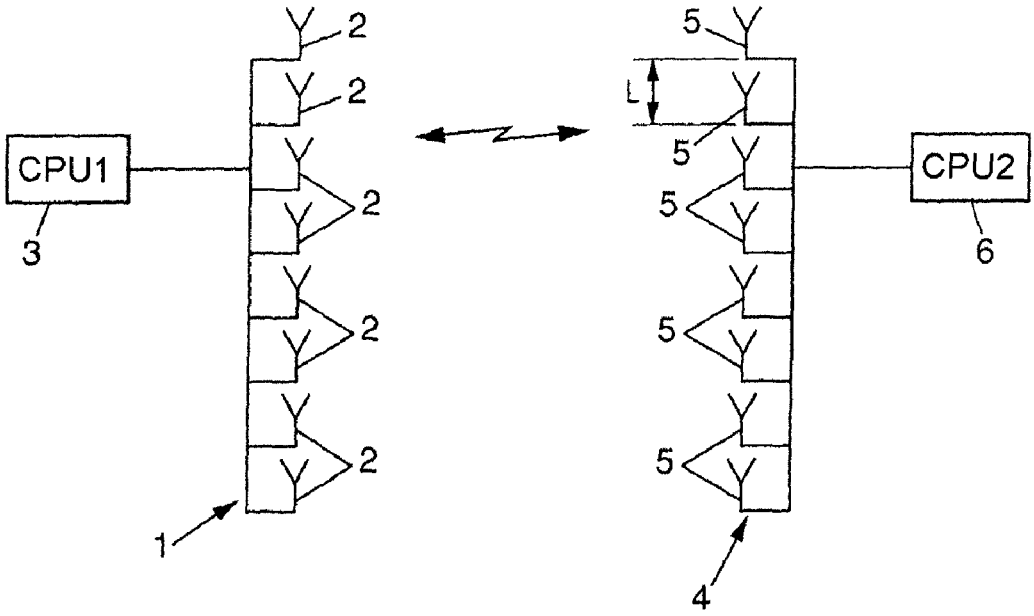
FIG. 1 is a diagram showing the principle of a device employing the focusing method according to one embodiment of the invention.

FIG. 1 shows a radiocommunication device operating with electromagnetic waves having a central frequency generally of between 0.7 and 50 GHz, for example around 2.45 GHz (corresponding to a wavelength of 12.25 cm). This device comprises a first array 1 of antennas 2, which are connected to a first electronic central processing unit 3 (CPU1) and a second array 4 of antennas 5, which are connected to a second electronic central processing unit 6 (CPU2).

The antennas 2, 5 here are 8 in number for each array 1, 4 but there could be a different number of them. In particular, the second array 4 could where appropriate comprise a single antenna 5.

The antennas 5 of the second array are separated from one another by a distance L (which may or may not be the same, depending on the pairs of antennas 5 in question), which is shorter than the wavelength $\lambda$ of the electromagnetic waves. For example, the distance L may be around 4 mm, i.e. slightly less than $\lambda/30$.

However, the first and second arrays 1, 4 are separated from each other by a distance that is relatively large compared with $\lambda$, this distance generally being greater than $3\lambda$.

Figure 2:
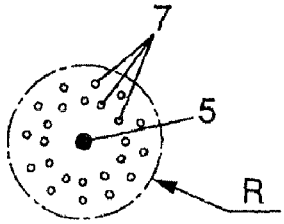
FIG. 2 is a top view of an antenna, surrounded by diffusers, belonging to one of the arrays of antennas of the device of FIG. 1.

As shown in FIG. 2, each antenna 5 of the second array is surrounded by a plurality of metallic diffusers 7, which are located within a radius R around the antenna 5. The radius R is less than $\lambda/2$, preferably less than $\lambda/10$ and especially less than $\lambda/50$.

Each antenna 5 is of the reactive type. In other words, the imaginary part of the impedance of the antenna is not negligible, so that the antenna 5 creates an evanescent field when it receives an electrical signal.

Advantageously, the imaginary part of the impedance of the reactive antenna is greater than the real part.

For example, the imaginary part of the impedance is greater than 50 times the real part of the impedance.

In the particular example considered here, the real part of the impedance is 10Ω and the imaginary part is 100 Ω.

In this way, the reactive antenna 5 essentially generates a reactive field when it receives an electrical signal, so that it then generates an evanescent electromagnetic wave located only around said reactive antenna (in contrast to a propagating wave that propagates to a relatively large distance relative to the antenna 5). The number of metallic diffusers 7 is greater than 10, for example greater than 20, in the zone of diameter R.

These metallic diffusers are for example simple conducting elements, for example copper wires.

As is known, these diffusers, when they receive the evanescent electromagnetic wave coming from the reactive antenna 5, convert this evanescent wave into a propagating wave. Conversely, when they receive an electromagnetic propagating wave, these diffusers 7 convert said propagating wave into an evanescent wave.

Figure 3:
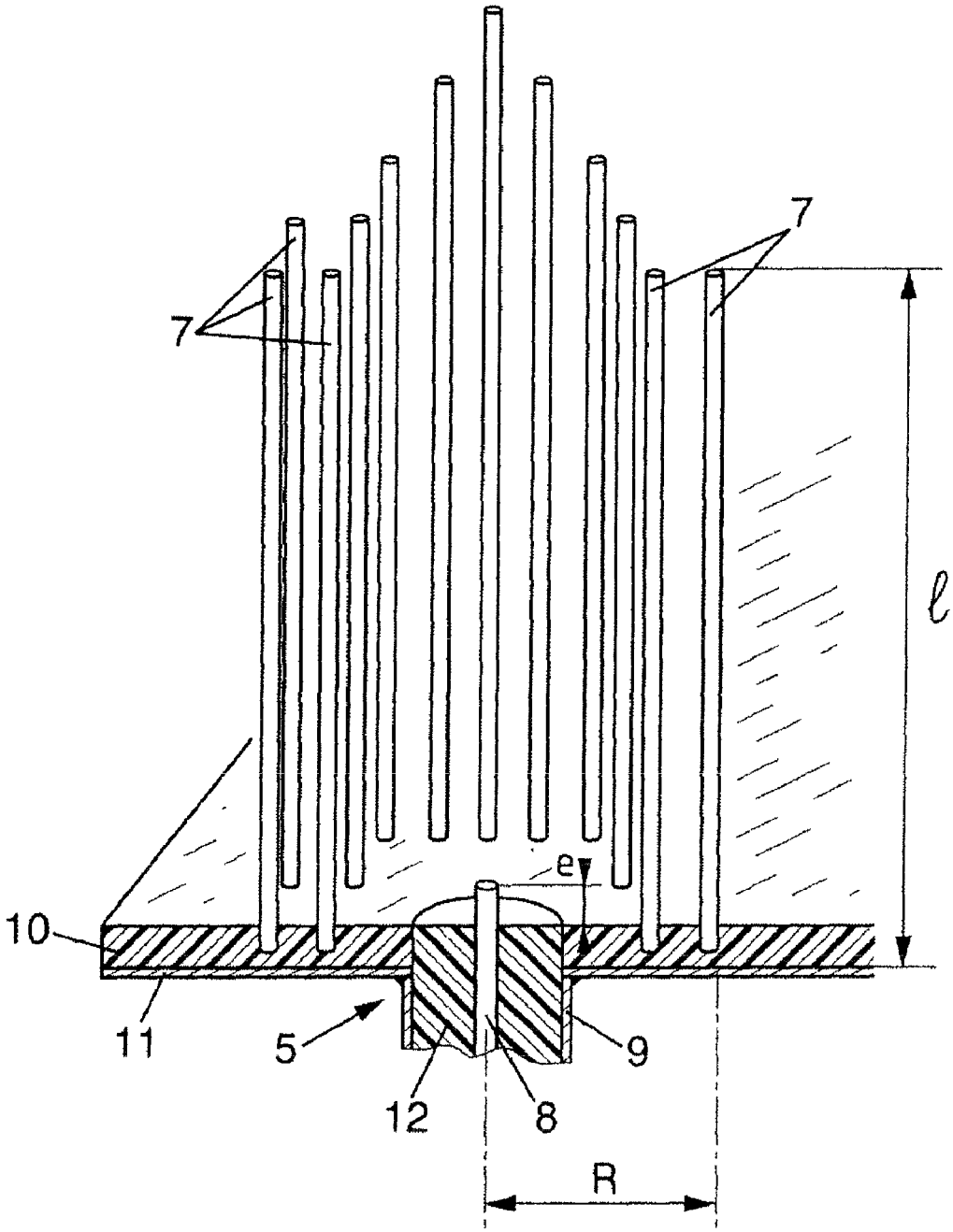
FIG. 3 is a perspective view showing the antenna and the metallic diffusers of FIG. 2, in an exemplary embodiment.

To give a nonlimiting example, FIG. 3 shows one embodiment of the reactive antenna 5 and reactive diffusers 7. In this example, the reactive antenna 5 may for example consist of a coaxial cable, the core 8 and the dielectric 12 of which pass through a resin plate 10, the underside of which has a metal layer 11 in electrical contact with the shield 9 of the coaxial cable, the core 8 projecting from the plate 10 by a short distance e, for example around 2 mm.

The distance e is preferably small compared to the wavelength $\lambda$. The core 8 may thus emit or receive electromagnetic waves over its short section projecting from the plate 10.

The metallic diffusers 7 here are for example in the form of fine copper wires, all mutually parallel and parallel to the abovementioned core 8. These copper wires have for example a length l of around 4 to 5 cm and may be fixed to the plate 10, for example by the resin forming this plate overmolding them.

In the example described here, the antennas 2 of the first array 1 are conventional antennas, placed at a relatively large distance apart compared to the antennas of the second array 4, but of course the first array 1 could be identical or similar to the second array 4.

The device that has just been described may be used for example for making the first array 1 communicate selectively (simultaneously or otherwise) with each antenna 5 of the second array 4.

For this purpose, during an initial learning step, each reactive antenna 5 is made to emit in succession an electromagnetic wave corresponding to a pulsed signal having for example a duration of the order of 10 ns.

This electromagnetic wave is received by the various antennas 2 of the first array 1, and the signals thus received by the antennas 2 correspond respectively to the impulse responses $h_{ij}(t)$ between the reactive antenna 5 that has emitted the signal and each antenna 2 of the first array, i being an index that denotes the reactive antenna 5 and j being an index that denotes the antenna 2 in question.

It should be noted that the impulse response $h_{ij}(t)$ could be determined in a different manner, for example by making the antennas j of the first array emit predetermined signals, by picking up the signals received by the antennas i of the second array, by transmitting the signals picked up at the first central processing unit 3 (this transmission may take place by wire, radio or other means) and by processing these picked-up signals. An example of a method of this type is given in document WO-A-2004/086557.

The first central processing unit 3 then performs a temporal inversion of these impulse responses so as thus to obtain signals $h_{ij}(-t)$.

This temporal inversion step may be carried out for example as described in the publication by Lerosey et al. (Physical Review Letters, May 14, 2004, The American Physical Society, Vol. 92, No. 19, pages 193904-1 to 193904-3).

Consequently, when it is desired to transmit a signal S(t) to one of the reactive antennas 5 of index i, is that the first central processing unit 3 makes each antenna 2 of index j emit a signal $S_{ji}(t)=S_i(t)\otimes h_{ij}(-t)$.

It should be noted that, in this way, the first central processing unit 3 may optionally transmit several signals $S_i(t)$ in parallel, respectively to several reactive antennas 5 of index $i_1$, $i_2$, $i_3$, etc.

In this way, during the focusing step, each antenna j of the first array is made to emit electromagnetic waves corresponding to a superposition of signals $S_{ji}(t)$ for several values of i (the signals $S_{ji}(t)$ corresponding to the various reactive antennas i are summed before the electromagnetic wave is emitted by each antenna of index j).

It should be noted that the bidirectional communication between the central processing units 3 and 6 may be further improved if the initial learning step is also carried out by making each antenna 2 emit a pulsed signal during the learning step so as to then calculate impulse responses $h_{ji}(t)$ between each antenna 2 of index j and each antenna 5 of index i. In this case, the second central processing unit 6 is also designed to calculate and store in memory the temporal inversions $h_{ji}(-t)$ of these impulse responses. In this case, when the second central processing unit 6 has to transmit a signal $S_j(t)$ to the antenna $\mathbf{2}_j$ of the first array 1, it makes all the reactive antennas 5 of index i emit signals $S_{ij}(t)=S_j(t)\otimes h_{ji}(-t)$.

As explained above, these signals $S_{ij}(t)$ may optionally be superposed for several values of j, so as to transmit in parallel various messages to the various antennas 2 from the first central processing unit 6.

The device that has just been described may be used for example to make electronic equipment items, such as microcomputers or the like, communicate with one another on the scale of a room or a building, or even to make various circuits within the same electronic equipment item communicate with one another, without a physical link between its circuit.

It should be noted that in communication applications, the abovementioned focusing could be replaced by a correlation based method or a method using a recording and an inversion of the transfer matrix in order to transmit a signal selectively to one of the reactive antennas 5.

Moreover, the invention may also be used to focus the electromagnetic waves on a small focal spot for the purpose of processing a material placed at this focal spot. In this case, the reactive antenna 5 may optionally be removed during the focusing step, the reactive diffusers however remaining present during this step.

Finally, the invention is not limited to electromagnetic waves, but could also be used to transmit ultrasonic waves.

The invention claimed is:

1. A method for the transmission of waves chosen from electromagnetic waves and acoustic waves, in order to focus a wave of wavelength λ at least one focal point of index i, the wave being emitted by antennas of index j belonging to a first array, towards at least one antenna located at the focal point i and belonging to a second array, wherein the antenna of said second array used at the focal point i is reactive, so that to generate an evanescent field, and at least one diffuser for the wave is used close to the focal point i, said diffuser being located at a distance smaller than a predetermined distance from said focal point, said predetermined distance being at most equal to λ/10.

2. The method as claimed in claim 1, comprising at least:

(a) a learning step in which an impulse response $h_{ij}(t)$ between the focal point i and each antenna j of the first array is determined from signals exchanged between the antennas j of the first array and at least one antenna located at the focal point i and belonging to a second array; and (b) a focusing step during which waves corresponding to signals $S_{ji}(t)=S_i(t)\otimes h_{ij}(-t)$, are emitted from said antennas j of the first array, where $S_i(t)$ is a function of the time and $h_{ij}(-t)$ is a temporal inversion of the impulse response $h_{ij}(t)$ between the focal point i and the antenna j, at least the diffuser remaining present around the focal point i during the focusing step.

3. The method as claimed in claim 2, in which, during the learning step:

a wave corresponding to a predetermined signal is emitted by the antenna of the second array, said antenna being located at said focal point i;

signals generated by said wave are picked up on the antennas of index j of the first array; and an impulse response $h_{ij}(t)$ between the focal point i and each antenna j of the first array is determined from the signals picked up.

4. The method as claimed in claim 2, in which the antenna of the second array is present at the focal point i during the focusing step and a communication is established between said antenna and the antennas of the first array.

5. The method as claimed in claim 2, in which the learning step is carried out for several focal points of index i where antennas of the second array are placed respectively, each having at least one diffuser located at a distance smaller than said predetermined distance relative to the corresponding focal point i, and, during the focusing step, electromagnetic waves corresponding to at least signals $S_{ji}(t)=S_i(t)\otimes h_{ij}(-t)$, are emitted at each antenna j of the first array, where i is the index of one of the desired focal points.

6. The method as claimed in claim 5, in which, during the focusing step, electromagnetic waves corresponding to a superposition of signals $S_{ji}(t)=S_i(t)\otimes h_{ij}(-t)$, for several values of i, are emitted by each antenna j of the first array.

7. The method as claimed in claim 5, in which the antennas of the second array are present at the focal points i during the focusing step and, during the focusing step, a selective communication is established between the antennas j of the first array and at least certain of said antennas of the second array.

8. The method as claimed in claim 1, in which several diffusers, preferably at least 10 diffusers, located at a distance smaller than said predetermined distance from the focal point i, are used.

9. The method as claimed in claim 1, in which the predetermined distance is at most equal to $\lambda/50$.

10. The method as claimed in claim 1, in which the wave is electromagnetic.

11. The method as claimed in claim 10, in which the wave has a frequency f of between 0.7 and 50 GHz.

12. The method as claimed in claim 10, in which the antenna of the second array used at the focal point has an impedance having an imaginary part greater than the real part, so as to essentially generate a reactive field.

13. The method as claimed in claim 12, in which the imaginary part of the impedance of the antenna of the second array is greater than 50 times the real part.

14. The method as claimed in claim 10, in which metallic diffusers are used.

15. A device for receiving an electromagnetic wave of wavelength $\lambda$, at least one point of index i, this device comprising:

an antenna located at the focal point i and belonging to a second array, that is reactive, so that to generate an evanescent field, and at least one metallic diffuser for the electromagnetic wave, these being located at a distance smaller than a predetermined distance from the point i, said predetermined distance being at most equal to $\lambda/10$, where $\lambda$ is the wavelength of the electromagnetic wave.

16. The device as claimed in claim 15, comprising several metallic diffusers, preferably at least 10 metallic diffusers, at a distance smaller than the predetermined distance from the point i.

17. The device as claimed in claim 15, in which the predetermined distance is at most equal to $\lambda/50$.

18. The device as claimed in claim 15, in which the antenna of the second array has an impedance having an imaginary part greater than the real part, so as to essentially generate an evanescent field.

19. The device as claimed in claim 18, in which the imaginary part of the impedance is greater than 50 times the real part.

20. The device as claimed in claim 15, comprising several antennas of index j belonging to a first array, and an electronic central processing unit controlling said antennas j of the first array in order for electromagnetic waves corresponding to signals $S_{ji}(t)=S_i(t)\otimes h_{ij}(-t)$, to be emitted by said antennas j of the first array, where $S_i(t)$ is a function of the time and $h_{ij}(-t)$ is a temporal inversion of the impulse response $h_{ij}(t)$ between the point i and each antenna j of the first array.

21. The device as claimed in claim 20, in which the second array comprises several antennas that are located at several points of index i and are surrounded by metallic diffusers located respectively at a distance smaller than said predetermined distance relative to the corresponding point i and the electronic central processing unit is designed to make each antenna j of the first array emit electromagnetic waves corresponding to at least signals $S_{ji}(t)=S_i(t)\otimes h_{ij}(-t)$.

22. The device as claimed in claim 21, in which the electronic central processing unit is designed to make each antenna j of the first array emit electromagnetic waves corresponding to a superposition of signals $S_{ji}(t)=S_i(t)\otimes h_{ij}(-t)$, for several values of i.

* * * * *